United States Patent [19]

Ikeda et al.

[11] Patent Number: 4,781,539

[45] Date of Patent: Nov. 1, 1988

[54] SHOE AND SWASH PLATE LUBRICATOR FOR A SWASH PLATE TYPE COMPRESSOR

[75] Inventors: Hayato Ikeda; Satoshi Kitahama, both of Kariya, Japan

[73] Assignee: Kabushiki Kaisha Toyoda Jikoshokki Seisakusho, Aichi, Japan

[21] Appl. No.: 61,653

[22] Filed: Jun. 11, 1987

[30] Foreign Application Priority Data

Jun. 13, 1986 [JP] Japan ..... 61-091216[U]

[51] Int. Cl.[4] ..... F04B 1/16; F04B 1/18; F01M 1/00

[52] U.S. Cl. ..... 417/269; 92/71; 184/6.17

[58] Field of Search ..... 417/269; 92/71; 184/11.1, 13.1, 6.17

[56] References Cited

U.S. PATENT DOCUMENTS

| | | | |
|---|---|---|---|
| 1,714,145 | 5/1929 | Sperry | 92/71 |
| 2,381,056 | 8/1945 | Huber | 417/269 |
| 3,057,545 | 10/1962 | Ransom et al. | 417/269 |
| 3,085,514 | 4/1963 | Budzich | 417/269 |
| 4,641,570 | 2/1987 | Futamura et al. | 417/269 |
| 4,868,252 | 2/1986 | Hattori et al. | 92/71 |

FOREIGN PATENT DOCUMENTS

| | | | |
|---|---|---|---|
| 48403 | 3/1984 | Japan | 417/269 |
| 48509 | 9/1985 | Japan | 417/269 |

*Primary Examiner*—William L. Freeh

*Attorney, Agent, or Firm*—Burgess, Ryan and Wayne

[57] ABSTRACT

A swash plate type compressor having a pair of axially combined front and rear cylinder blocks forming therein a plurality of cylinder bores and a swash plate chamber into which an oil-contained refrigerant is introduced from an air-conditioning circuit, a drive shaft centrally rotatably mounted in the combined cylinder block, a swash plate having sliding contact faces oblique to an axis of the drive shaft, and supported on the drive shaft so that the swash plate is rotated within the swash plate chamber, compressing double-headed pistons slidably fitted in the cylinder bores, shoes intervened between the swash plate and the pistons for causing reciprocating motions of the pistons in response to rotating motion of the swash plate, and a shoe and swash plate lubricator for constantly supplying a lubricating oil component contained in the refrigerant gas between the swash plate and the shoes. The shoe and swash plate lubricator is formed by recessed portions arranged in a determined part of the sliding contact faces of the swash plate, and captures and retains the oil-contained refrigerant at a position adjacent to the circularly extending flat path of the swash plate in sliding contact with the shoes while the swash plate is rotating within the swash plate chamber, to constantly supply the oil-contained refrigerant to each of the shoes and the swash plate per se.

4 Claims, 5 Drawing Sheets

SHOE AND SWASH PLATE LUBRICATOR FOR A SWASH PLATE TYPE COMPRESSOR

BACKGROUND OF THE INVENTION

1. Field of the Invention

The present invention relates to a swash-plate operated reciprocatory piston type compressor (hereinafter referred to as a swash plate type compressor) for use in air-conditioning systems for vehicles and, in particular, to an improved shoe and swash plate lubricator incorporated into a swash plate type compressor to supply sliding contact faces of a swash plate and shoes intervened between the swash plate and reciprocatory pistons with a required amount of lubricating oil during the operation of the compressor.

2. Description of the Related Art

A typical swash plate type compressor as disclosed in, for example, U.S. Pat. No. 3,801,227 to Nakayama and U.S. Pat. No. 3,955,899 to Nakayama et al., is provided with a pair of horizontal axially aligned front and rear cylinder blocks which form a combined cylinder block, and the combined cylinder block is closed at both ends by front and rear housings, via valve plates. The front and rear housings form refrigerant suction chambers and refrigerant discharge chambers, and inside the combined cylinder block are formed a plurality of cylinder bores arranged around a central axis of the combined cylinder block and having axes in parallel with the central axis. Each of the cylinder bores is interconnected to the suction and discharge chambers of the front and rear housings. The combined cylinder block also has a centrally longitudinal bore formed therein, and a drive shaft rotatably mounted therein, and a swash plate chamber in which a swash plate keyed on the drive shaft is rotatably received. The swash plate rotates with the drive shaft and is operatively engaged with double-headed pistons slidably fitted in the cylinder bores so as to reciprocate the pistons across the swash plate chamber. That is, shoes are arranged between the swash plate and the double-headed pistons to provide a universal coupling therebetween and to cause a reciprocatory compressing motion of the pistons within the cylinder bores in response to the rotation of the swash plate. The central portion of each of the double-headed pistons is provided with a recess through which the swash plate passes during the rotation thereof, and a pair of spherical sockets to receive the shoes. Each of the shoes has a circular flat face in sliding contact with the oblique face of the swash plate and a half-spherical face in sliding engagement with the socket of the associated piston.

With the above-mentioned swash plate type compressor, when the compressor is used for compressing a refrigerant gas of the air-conditioning system of a vehicle, a refrigerant gas containing a lubricating oil is introduced from the outside air-conditioning circuit into the suction chambers, via the swash plate chamber, and is discharged from the compressor toward the outside air-conditioning circuit after compression. The lubricating oil contained in the refrigerant gas lubricates the contacting faces of the shoes and the swash plate and respective sockets of the pistons when the oil enters the swash plate chamber. However, since the circular flat face of each shoe and the oblique face of the swash plate are in close contact, sometimes a sufficient amount of lubricating oil is not supplied to the contacting faces of the shoe and swash plate. Moreover, since the lubricating oil entering the swash plate chamber is subjected to centrifugal force by the rotating swash plate and is scattered radially outward within the swash plate, the lubricating oil cannot be retained between the shoes and the swash plate. Thus, a lack of lubrication for the swash plate and the shoes engaged with respective double-headed pistons occurs. This lack of lubrication becomes greater when the shoes are engaged with pistons located remote from a return gas inlet through which the refrigerant gas as well as the lubricating oil are introduced into the swash plate chamber of the compressor. Therefore, abrasion of a local portion of the swash plate and the flat faces of the shoes takes place during the operation of the swash plate type compressor due to an insufficient or a lack of lubrication. As a result, inaccurate reciprocating motion of the double-headed pistons, i.e., a lost motion of the pistons due to undesirable play between the pistons and the shoes occurs, and the compressor will generate noise during the operation of the compressor.

Further, in an extreme case, the insufficient or lack of lubrication causes frictional contact between the oblique faces of the swash plate and the flat faces of the respective shoes, resulting in the generation of a high temperature friction heat which cause a seizing of the contacting faces of the swash plate and the shoes, thus reducing the operational life of the compressor.

SUMMARY OF THE INVENTION

Therefore, an object of the present invention is to obviate the above-mentioned problems encountered by the conventional swash plate type compressor.

Another object of the present invention is to provide an improved shoe and swash plate lubricator incorporated into a swash plate type compressor.

A further object of the present invention is to provide a swash plate type compressor in which sufficient lubrication can be always supplied between a swash plate and respective shoes operatively engaging between the swash plate and compressor pistons during the operation of the compressor.

A still further object of the present invention is to provide a swash plate type compressor with a swash plate having a novel construction whereby lubricating oil is retained in the swash plate, thereby ensuring a smooth supply of the lubricating oil to the contacting faces of the swash plate and shoes received in respective compressor pistons.

In accordance with the present invention, there is provided a swash plate type compressor having a pair of axially combined front and rear cylinder blocks having formed a plurality of cylinder bores therein and a swash plate chamber into which an oil-contained refrigerant is introduced from an air-conditioning circuit; a pair of front and rear housing arranged at axial ends of the combined cylinder block, each housings having therein a suction chamber for the oil-contained refrigerant before compression, fluidly interconnected with the swash plate chamber of the combined cylinder block, and a discharge chamber for compressed refrigerant which is delivered to the air-conditioning circuit; a drive shaft centrally and rotatably mounted in the combined cylinder block; a swash plate having faces oblique to an axis of the drive shaft, and supported on the drive shaft, the swash plate being rotatably received in the swash plate chamber; reciprocatory compressing pistons slidably fitted in the cylinder bores; shoes intervened between the swash plate and the pistons for causing a reciprocating motion of the pistons in response to a rotating motion of the swash plate, each shoe having a flat face in sliding contact with a circularly extending flat contact path provided on one of the oblique faces of the swash plate, and a spherical face formed on an opposite side of the flat face and slidably engaged with one of the pistons; and a shoe and swash plate lubricator for constantly supplying lubricating oil between the swash plate and the shoes. The shoe and swash plate lubricator capturing and retaining the oil-contained refrigerant on each of the oblique faces of the swash plate at a position adjacent to the circularly extending flat contact path of the swash plate while the swash plate is rotating within the swash plate chamber, thereby supplying the oil-contained refrigerant to each of the shoes.

When the swash plate carries out each one complete revolution, although a predetermined circumferentially angular section of each of the oblique faces of the rotating swash plate contributes to causing a compressing operation of the plurality of compressor pistons, via the shoes, against pressure of the compressed refrigerant, the remaining circumferentially angular section of each of the oblique faces of the swash plate does not contribute to causing a compressing movement of each piston and contributes only to supporting the shoes engaged with the pistons carrying out a pumping operation. Therefore, the present inventors have contrived to employ the latter remaining circumferentially angular section of each of the oblique faces of the swash plate to form the shoe and swash plate lubricator. That is, at least one circularly extending recess capable of capturing and retaining the oil-contained refrigerant is formed in the above-mentioned remaining circumferentially angular section of each of the oblique faces of the swash plate while defining, adjacent to the recess, a circularly extending narrow path used as a sliding contact face with the flat faces of the shoes.

DESCRIPTION OF THE DRAWINGS

The above and other objects, features and advantages of the present invention will become more apparent from the ensuing description of the embodiments of the present invention taken in conjunction with the accompanying drawings wherein.

DESCRIPTION OF THE PREFERRED EMBODIMENTS

Figure 1:
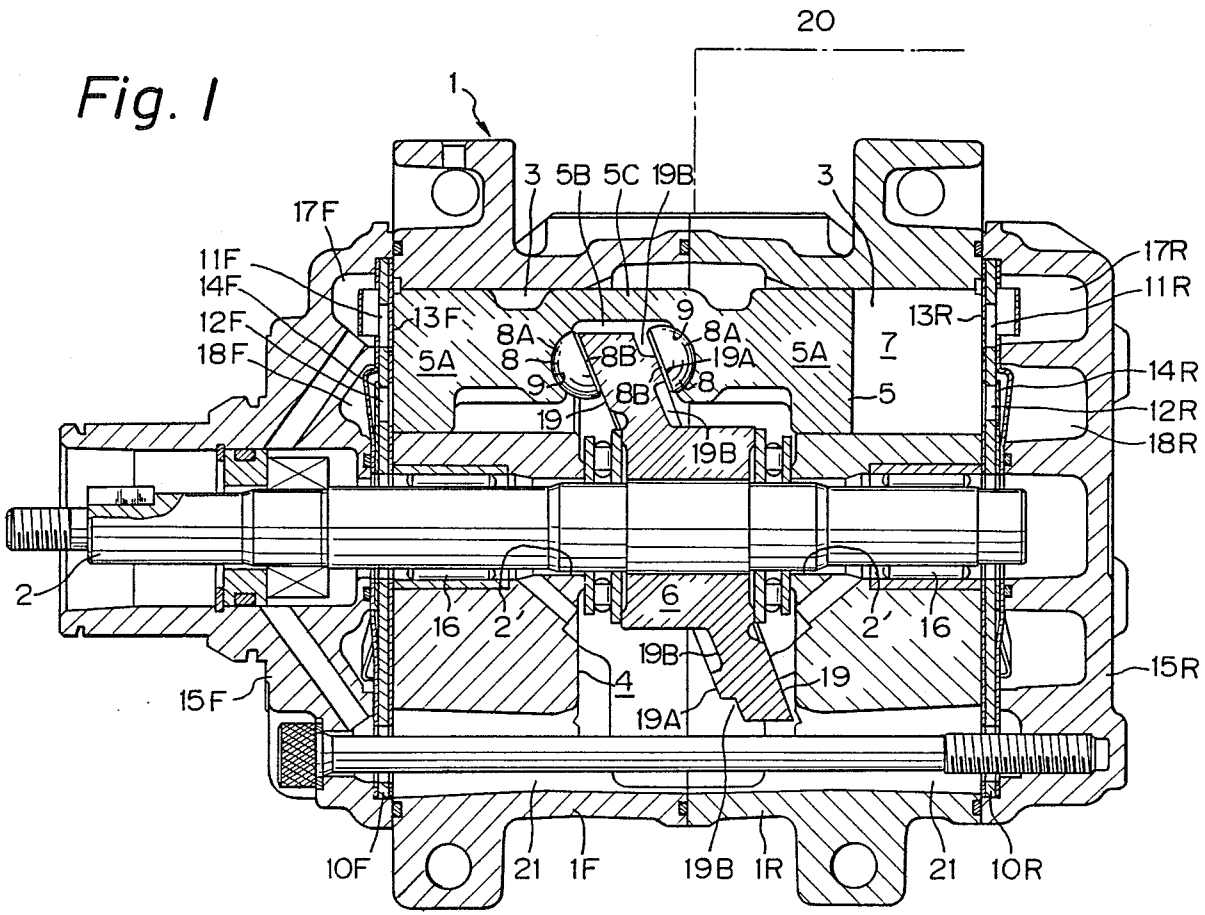
FIG. 1 is a longitudinal cross sectional view of a swash plate type compressor provided with a shoe and swash plate lubricator according to an embodiment of the present invention.
Figure 2:
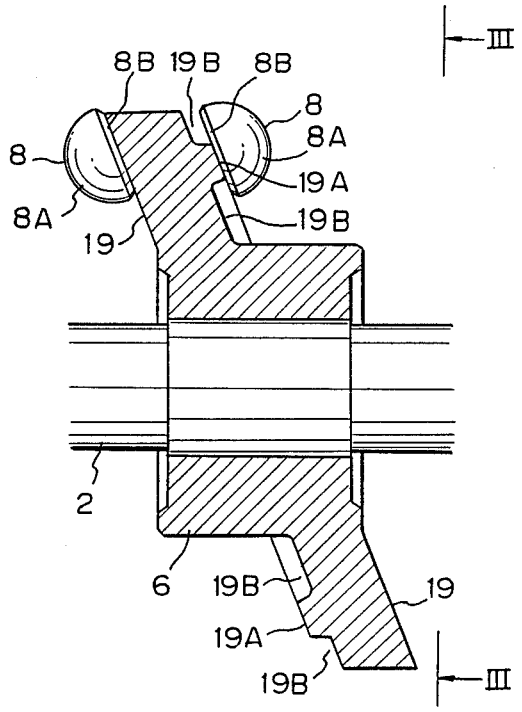
FIG. 2 is a slightly enlarged cross-sectional view of a swash plate supported on a drive shaft and shoes engaged with the swash plate, illustrating how the oil-contained refrigerant is retained on the oblique faces of the swash plate.
Figure 3:
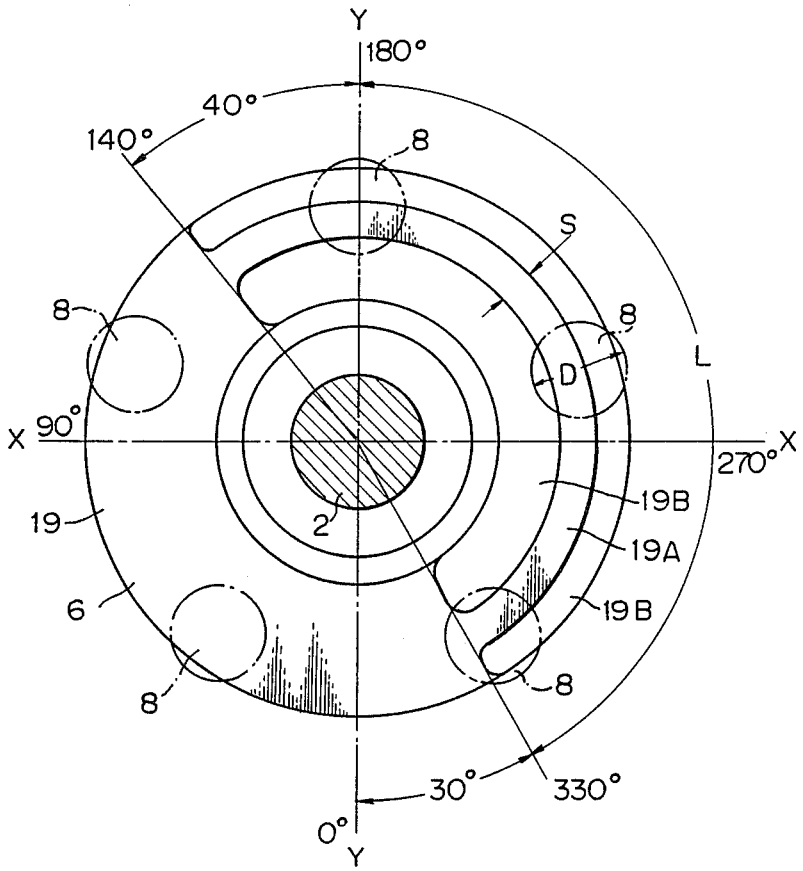
FIG. 3 is a side view of the swash plate, taken along the line III—III of FIG. 2.

Referring to FIGS. 1 through 3, a swash plate type compressor according to a first embodiment of the present invention, is provided with a front cylinder block 1F and a rear cylinder block 1R axially tightly combined together to form a combined cylinder block 1, and a central bore 2' for receiving a drive shaft 2 is formed through the combined cylinder block 1. The drive shaft 2 is rotatably supported by a pair of anti-friction bearings 16 seated in the central bore of the combined cylinder block 1. One end of the drive shaft 2 is extended so as to project from a later-described front housing 15F, and via an electro-magnetic clutch (not shown), is connectable to a vehicle engine so that a rotary drive force is transmitted from the engine to the drive shaft 2 is response to a connection by the electromagnetic clutch. A plurality of axial cylinder bores 3 (five in the present embodiment) are formed in the combined cylinder block 1 in an equiangular arrangement on a circle around the central bore 2' in parallel with the axis of the drive shaft 2.

Each cylinder bore 3 has a front cylinder bore section formed in the front cylinder block 1F and a rear cylinder bore section formed in the rear cylinder block 1R, respectively, and is separated by a swash plate chamber 4 provided in the axially central portion of the combined cylinder block 1. A double-headed piston 5 having front and rear piston heads 5A described later is slidably fitted in each cylinder bore 3 for reciprocation in the cylinder bore 3. Compression chambers 7 are formed in the cylinder bores 3 between a front valve plate 10F and a rear valve plate 10R, which will be described hereinafter, and the opposite ends of respective double-headed pistons 5. A swash plate 6 having front and rear oblique faces inclined with respect to the axis of the drive shaft 2 is fixedly mounted on the drive shaft 2 for rotation with the drive shaft 2 within the swash plate chamber 4. The front and rear oblique faces of the swash plate 6 are provided as sliding contact faces 19 in sliding contact with shoes 8 which are retained between the swash plate 6 and the pistons 5 to cause a reciprocation of the pistons 5 within the cylinder bores 3 in response to the rotation of the swash plate 6. Each of the double-headed pistons 5 is provided with the front and rear piston heads 5A formed on the opposite ends of the entire body of the piston 5, and a cylindrical connecting portion 5C having therein a central recessed portion 5B for receiving the shoes 8 as well as to permit rotation of the swash plate 6 therethrough. Within the central recessed portion 5C of each piston 5 is formed a pair of spherical sockets 9 for receiving the shoes 8 and forming a pair of ball-and-socket joints between front and rear piston heads 5A of the piston 5 and the sliding contact faces 19 of the swash plate 6. Each of the shoes 8 is provided with a spherical portion 8A complementary with the spherical socket 9 of the piston 5 and a circular flat face 8B in sliding contact with the sliding contact face 19 of the swash plate 6.

At this stage, as shown in FIGS. 2 and 3, each of the sliding contact faces 19 (the oblique faces) of the swash plate 6 has a circularly extending narrow path 19A formed between a pair of circularly extending and radially spaced recessed portions 19B. The circularly extending narrow path 19A is a portion that is in sliding contact with the circular flat face 8B of each of the shoes 8 when each of the piston heads A is in the suction or pumping stroke thereof (i.e., the movement of each piston head 5A away from the valve plate 10F or 10R, permitting the refrigerant gas to enter into the compression chamber 7 of the cylinder bore 3) and is angularly extended from a 140 degree position to a 330 degree position in the case of five double-headed pistons 5, as shown in FIG. 3. The other face area of each sliding contact face 19 of the swash plate 6, i.e., the portion angularly extended from a 330 degree position to a 140 degree position through a 0 degree position and a 90 degree position is a portion that contributes to causing a compression operation of each of the five piston heads 5A. As best shown in FIG. 3, a radial width "S" of the circularly extending narrow path 19A is determined so as to be equal to or less than the diameter "D" of the circular flat face 8A of the shoe 8. Therefore, when the radial width "S" of the narrow path 19A is less than the diameter "D" of the circular flat face 8A of the shoe 8, the shoe 8 is in sliding contact with the circularly extending narrow path 19A of the swash plate 6 in such a manner that only a central part of the circular flat face 8A of each shoe 8 is in sliding contact with the path 19A, as will be understood from the illustration of FIG. 3. That is, a considerable part of the circular flat face 8A of each shoe 8 is exposed to the recessed portions 19B of the swash plate 6 which function to capture and retain therein the oil-suspended refrigerant, as described later.

The front housing 15F and the rear housing 15R close respective axial open ends of the combined cylinder block 1. The front valve plate 10F and the rear valve plate 10R are placed between the front housing 15F an the front cylinder block 1F and between the rear housing 15R and the rear cylinder block 1R, respectively. An annular suction chamber 17F and an annular discharge chamber 18F separated from the suction chamber 17F by an annular separating wall are concentrically formed in the front housing 15F in such a manner that both chambers 17F and 18F are communicatable with each of the cylinder bores 3, while an annular suction chamber 17R and an annular discharge chamber 18R separated from the suction chamber 17R by an annular separating wall are concentrically formed in the rear housing 15R in such a manner that both chambers 17R and 18R are communicatable with the cylinder bores 3. The discharge chambers 18F and 18R are arranged near the respective centers of the front and rear housings 15F and 15R, respectively. The suction chambers 17F and 17R are arranged near the circumferences of the front and rear housings 15F and 15R, respectively, so as to surround the associated suction chambers 17F and 17R, respectively.

Suction ports 11F and 11R are formed in the front and rear valve plates 10F and 10R, respectively so as to provide a fluid communication between the suction chambers 17F and 17R and each of the cylinder bores 3 in response to opening of suction valves 13F and 13R, respectively, during the suction stroke of respective piston heads 5A of the double-headed pistons 5. On the other hand, discharge ports 12F and 12R are formed in the same front and rear valve plates 10F and 10R, respectively so as to provide a fluid communication between the discharge chambers 18F and 18R and each of the cylinder bores 3 in response to the opening of discharge valves 14F and 14R, respectively, during the compression stroke of respective piston heads 5A of the double-headed pistons 5.

The operation of the compressor having the abovedescribed construction of the swash plate type compressor of FIGS. 1 through 3 will be described hereinbelow.

When the electro-magnetic clutch (not shown) is connected so that the rotary drive force of the vehicle engine is transmitted to the drive shaft 2 of the compressor, the swash plate 6 secured on the drive shaft 2 is brought into a rotation within the swash plate chamber 4. Therefore, the swash plate 6 which is operatively engaged with the respective pistons 5, via the respective pair of shoes 8, causes the continuous reciprocating motion of the respective pistons 5, i.e., the compressing motion and the pumping (sucking) motion of the piston heads 5A of respective double-headed pistons 5.

When the oil-contained refrigerant gas returning under pressure from an evaporator of the air-conditioning circuit through a suction conduit 20 (FIG. 1) enters the swash plate chamber 4 of the compressor, the refrigerant gas fills up the swash plate chamber 4 and then flows through passages 21 into the suction chambers 17F and 17R of the front and rear housings 15F and 15R. Subsequently, the refrigerant in the suction chambers 17F and 17R is successively pumped into the plurality of cylinder bores 3 through the suction ports 11F and 11R in response to successive opening of the suction valves 13F and 13R caused by the cyclic pumping motions of the piston heads 5A of the double-headed pistons 5. The refrigerant pumped into the cylinder bores 3 is then compressed by the piston heads 5A of the pistons 5 during the compressing stroke of the respective piston heads 5A. The compressed refrigerant gas is further forcibly sent into the discharge chambers 18F and 18R through the discharge ports 12F and 12R of the valve plates 10F and 10R in response to successive openings of the discharge valves 14F and 14R during the cyclic compression stroke of the respective piston heads 5A of the double-headed pistons 5. The compressed refrigerant gas is then discharged toward the air-conditioning circuit.

While the oil-contained refrigerant is subjected to the above-described suction and compression by the double-headed pistons 5 within the combined cylinder block 1 of the swash plate type compressor, the oil-contained refrigerant gas contributes to lubrication of the sliding contact faces 19 of the swash plate 6 and the respective pairs of shoes engaged with the double-headed pistons 5 in the manner described below. That is, part of the oil-contained refrigerant gas filling up the swash plate chamber 4 is captured by an retained in the circularly extending recessed portions 19B of the rotating swash plate 6. Therefore, while the oil-contained refrigerant retained in the recessed portions 19B of the swash plate 6 is being rotated together with the swash plate 6, and when the recessed portions 19B of the swash plate 6 approach and go past each of the shoes 8 held by the piston heads 5A in the pumping stroke, the oil component of the refrigerant gas sufficiently lubricates the sliding contact portions of the circular flat faces 8A of respective shoes 8 and the narrow contact paths 19A of the swash plate 6. Since the swash plate 6 continuously rotates, all of the sliding contact faces 19 of the swash plate 6 are eventually lubricated by the oil-contained refrigerant. Thus, the provision of the recessed portions 19B and the narrow contact paths 19A for the swash plate 6 improves a lubrication effect applied to the shoes 8 and the swash plate 6 per se, compared to the prior art compressor. Further, since a part of the oil-contained refrigerant gas retained in the recessed portions 19B of the swash plate 6 splashes into the swash chamber 4 due to the rotation of the swash plate 6, the splashing oil can lubricate other parts and elements of the compressor, such as thrust bearings and the respective cylinder bores 3. As a result, within the swash plate chamber 4, the lubrication effect achieved by the oil-contained refrigerant gas can be generally high, compared with the prior art compressor.

Additionally, since the recessed portions 19B are circularly extended in both sliding faces 19 of the swash plate 6, the portions 19B can also function as guide passageways of the refrigerant gas within the swash plate chamber 4. Thus, an effective area of the passageways for permitting the refrigerant to flow the swash plate chamber 4 toward the suction chambers 17F and 17R is increased compared with the prior art compressor.

Figure 4:
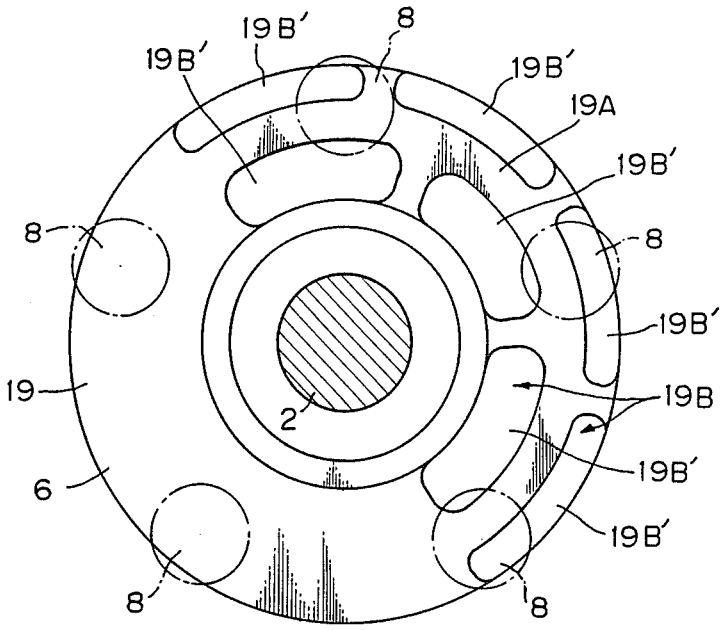
FIG. 4 is a similar side view of a swash plate according to another embodiment of the present invention.

FIG. 4 illustrates a swash plate of the swash plate type compressor according to another embodiment of the present invention.

Referring to FIG. 4, the swash plate 6 of this embodiment is different from the swash plate 6 of the previous embodiment in that the recessed portions 19B are formed by a plurality of separate recessed sections 19B' arranged equiangularly in each sliding contact face 19 of the swash plate 6 in a region which contributes only to supporting the shoes 8 held by the piston heads 5A of the respective double-headed pistons 5 involved in the pumping stroke thereof. A circularly extending narrow path 19A on each of the sliding contact faces 19 of the swash plate 6 is substantially the same as that of the swash plate 6 of the previous embodiment. It should be noted that a region of each sliding contact face 19 of the swash plate 6 which directly contributes to the application of an axial force causing the compressing motion of the piston heads 5A of the respective double-headed pistons 5 during the rotation of the swash plate 6, is formed with neither the recessed portion 19B nor the narrow path 19A, as will be understood from the illustration of FIG. 4.

In accordance with the construction of the swash plate 6 of FIG. 4, since the separate recessed sections 19B' are formed in the shape of a refrigerant sump, respectively, the sections 19B' can effectively capture and retain the oil-suspended refrigerant gas within the swash plate chamber 4. Therefore, supply of the lubricating oil to the shoes 8 and the swash plate 6 per se can be achieved more effectively than in the case of the previous embodiment.

In the foregoing two embodiments of the present invention, a plurality of recessed portions 19B are disposed along the radially outer and inner edges of the circularly extending narrow paths 19A of the swash plate 6. However, the recessed portions 19B may be disposed on only one of both radial sides of each narrow path 19A of the swash plate 6, if needed.

Figure 5:
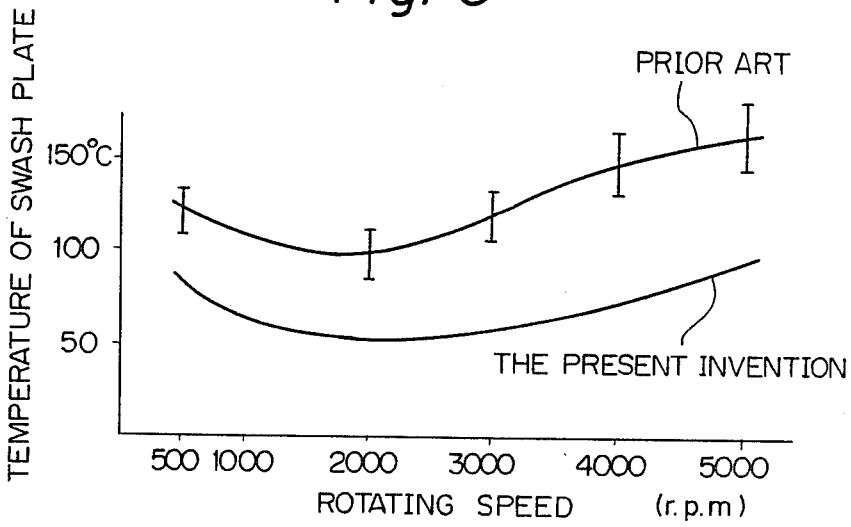
FIG. 5 is a graph illustrating a temperature rise in a swash plate of the present invention compared with that in a swash plate of the prior art; and, FIG. 6 is a graph illustrating an amount of abrasion of a swash plate of the present invention compared with that of a swash plate of the prior art.
Figure 6:
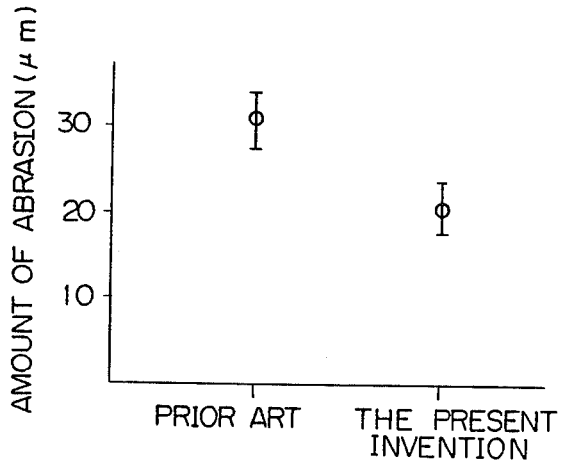

FIGS. 5 and 6 illustrate the results of a measurement of change in the temperature of a swash plate with a change in the rotating speed of the swash plate and a change in the amount of abrasion of the swash plate, respectively, obtained through the comparative experiments with respect to a swash plate type compressor according to the present invention and that of the prior art. From the illustration of FIGS. 5 and 6, it will be readily understood that, according to the present invention, the temperature rise of the swash plate is less than the case of the prior art over the entire rotating speed range of the swash plate, and that the amount of abrasion of the sliding contact faces of the swash plate according to the present invention is small compared with the prior art.

From the foregoing description of the preferred embodiments of the present invention, it will be understood that, according to the present invention, the rotating swash plate and the shoes in sliding contact with the swash plate are sufficiently lubricated by the oil-contained refrigerant entering the swash plate chamber. As a result, local abrasion of the swash plate and abrasion of the contact faces of the shoes can be considerably avoided, and a seizure of the shoes on the swash plate during the operation of the swash plate type compressor is effectively prevented.

However, it should be understood that many modification and variations will occur to persons skilled in the art without departing from the scope and spirit of 5 the present invention.

We claim:

1. A swash plate type compressor comprising:

a pair of axially combined front and rear cylinder blocks forming therein a plurality of cylinder bores and a swash plate chamber into which an oil-contained refrigerant is introduced from an air-conditioning circuit;

a pair of front and rear housings arranged at axial ends of the combined cylinder block, each housing having therein a suction chamber for the oil-contained refrigerant before compression, fluidly interconnected with the swash plate chamber of the combined cylinder block, and a discharge chamber for compressed refrigerant which is delivered to an outer air-conditioning circuit;

a drive shaft centrally rotatably mounted in the combined cylinder block;

a swash plate having sliding contact faces oblique to an axis of the drive shaft, and supported on the drive shaft so as to be rotated with said drive shaft, the swash plate being rotated in said swash plate chamber;

a plurality of reciprocatory double-headed pistons slidably fitted in the cylinder bores, each piston having two axially spaced piston heads alternatively carrying out compression and suction motions;

a plurality of pairs of shoes, each pair of shoes being held by one of said plurality of said double-headed pistons and arranged in sliding contact with said swash plate for causing a reciprocating motion of said one of said plurality of pistons in response to a rotation of said swash plate, each shoe having a circular flat face in sliding contact with a circularly extending flat contact path provided on one of said oblique faces of said swash plate, and a spherical face formed on an opposite side of said flat face and slidably socketed in one of said piston heads of said one of said pistons; and lubricating means arranged in said swash plate chamber for capturing and retaining said oil-contained refrigerant within said swash plate chamber, thereby constantly supplying said captured oil-contained refrigerant to said swash plate and said plurality of pairs of shoes during rotation of said swash plate, said lubricating means including:

(a) at least one circularly extending recessed portion formed in a predetermined angularly extended region of each of said sliding contact faces of said swash plate, which region does not contribute to an application of a force for causing said compression motion of said each piston head of said each of said plurality of double-headed pistons, said circularly extending recessed portion capturing and retaining said oil-contained refrigerant within said swash plate chamber in response to rotation of said swash plate; and (b) a narrow flat path circularly extending in parallel with and arranged adjacent to said circularly extending recessed portion in each of said sliding contact faces of said swash plate, said narrow flat path on each of said sliding contact faces of said swash plate being in sliding contact with said circular flat face of a respective one of each of said plurality of pairs of shoes during rotation of said swash plate.

2. A swash plate type compressor according to claim 2, wherein said at least one circularly extending recessed portion formed in a predetermined angularly extended region of each of said slide contact faces of said swash plate comprises a plurality of separate recessed sections spaced apart from one another in a circumferential direction of said swash plate.

3. A swash plate type compressor according to claim 1, wherein said lubricating means arranged in said swash plate chamber for capturing and retaining said oil-contained refrigerant within said swash plate chamber, comprises:

a pair of circularly extending recessed portions formed in a predetermined angularly extended region of each of said sliding contact faces of said swash plate, which region does not contribute to an application of a force for causing said compression motion to said each piston head of said each of said plurality of double-headed pistons, said circularly extending recessed portions capturing and retaining said oil-contained refrigerant within said swash plate chamber in response to rotation of said swash plate; and, a narrow flat path circularly extending in parallel with said circularly extending recessed portion in each of said sliding contact faces of said swash plate, said narrow flat paths on both of said sliding contact faces of said swash plate being in sliding contact with said circular flat faces of said plurality of pairs of shoes during rotation of said swash plate.

4. A swash plate type compressor according to claim 1, wherein said narrow path of each of said sliding contact faces of said swash plate has a radial width equal to or less than a diameter of said circular flat face of said each shoe, whereby said circular flat face of said each shoe has a portion thereof exposed to said recessed portion of said swash plate.

* * * * *

UNITED STATES PATENT AND TRADEMARK OFFICE

CERTIFICATE OF CORRECTION

PATENT NO. : 4,781,539

DATED : November 1, 1988

INVENTOR(S) : Ikeda et al.

It is certified that error appears in the above-identified patent and that said Letters Patent is hereby corrected as shown below:

Column 9, lines 19 and 20: change "claim 2" to read

--claim 1--

Signed and Sealed this

Twenty-third Day of May, 1989

*Attest:*

DONALD J. QUIGG

*Attesting Officer*

*Commissioner of Patents and Trademarks*